United States Patent [19]

Gilliams et al.

[11] 4,123,374

[45] Oct. 31, 1978

[54] ELECTROPHORETIC DEVELOPMENT

[75] Inventors: Yvan K. Gilliams, Hever; Noël J. De Volder, Edegem; Walter F. De Winter, 's-Gravenwezel; Bernard H. Tavernier, Edegem, all of Belgium

[73] Assignee: Agfa-Gevaert N.V., Mortsel, Belgium

[21] Appl. No.: 760,516

[22] Filed: Jan. 19, 1977

[30] Foreign Application Priority Data

Jan. 23, 1976 [GB] United Kingdom ..... 2699/76

[51] Int. Cl.$^2$ ..... G03G 9/12

[52] U.S. Cl. ..... 252/62.1 L; 96/1 LY; 427/17; 427/15; 526/317; 526/318; 526/320

[58] Field of Search ..... 96/1 LY; 252/62.1 L; 526/318, 317, 320; 427/17, 15

[56] References Cited

U.S. PATENT DOCUMENTS

| | | | |
|---|---|---|---|
| 3,753,760 | 8/1973 | Kosel | 252/62.1 L |
| 3,793,015 | 2/1974 | Van Engeland et al. | 252/62.1 L |
| 3,874,896 | 4/1975 | Machida et al. | 252/62.1 L |

*Primary Examiner*—John D. Smith
*Attorney, Agent, or Firm*—William J. Daniel

[57] ABSTRACT

A liquid developer composition suitable for use in developing electrostatic charge patterns, which composition contains in an electrically insulating carrier liquid having a volume resistivity of at least $10^9$ Ohm·cm and a dielectric constant below 3, a dispersed particulate coloring substance bearing one or more charge control substances and an organic polymeric material, wherein said polymeric material is a copolymer containing the following recurring units (A) and (B) or (A) and (C):

(A)

(B)

(C)

wherein:

R represents hydrogen or an alkyl group of 1 to 4 carbon atoms, $R^1$ represents hydrogen or an acyl group, $R^2$ represents hydrogen or carboxyl in free acid or salt form, $R^3$ represents hydroxyl or an ether group, A represents an alkylene chain of 12 to 20 carbon atoms, $Y^1$ represents —CO—O—$CH_2$—CHOH—$CH_2$—

$Y^2$ represents —CO—, and $x$ represents 4 to 20.

12 Claims, No Drawings

ELECTROPHORETIC DEVELOPMENT

The present invention relates to improvements in the development of electrostatic charge patterns on a dielectric material and to liquid developers used therefor.

Known electrophotographic processes comprise the steps of electrostatically charging in the dark a photoconductive surface, image-wise exposing said surface whereby the irradiated areas become discharged in accordance with the intensity of radiation, thus forming a latent electrostatic image, and developing the material to form a visible image by depositing on the image a finely divided electroscopic material known as "toner". The toner particles consist of or include colouring substances which may be black. The thus developed image may be fixed to the surface of the photoconductor or transferred to another surface and fixed thereon. Instead of forming the latent electrostatic image by the steps described above it is also possible to directly charge the photoconductive layer in image configuration.

A process of developing an electrostatic image by use of an electrically insulating liquid developer, which contains dispersed particles of colouring substance that render the charge pattern visible through the phenomenon of electrophoresis, has already been described e.g. in the U.S. Pat. No. 2,907,674 of Kenneth Archibald Metcalfe and Robert John Wright issued Oct. 6, 1959.

In electrophoretic development a distinction is made between developers having dispersed toner particles, which possess a positive charge, and those using toner particles which possess a negative charge. The charge value and the polarity of the toner particles are influenced by means of one or more so-called charge control agents.

In order to fix the toner particles on the places where they are deposited electrostatically, each particle comprises a thermoplastic resin coating, which may also play the role of dispersing agent. These resins may further serve as charge control agent or may be electrically inert.

Charging of the dispersed particles may proceed according to one method by a chemical compound that provides a charge from a chemical dissociation reaction on the toner particle surface and the introduction of a counter-ion in the electrically insulating carrier liquid.

The present invention is concerned with electrophoretic liquid developers in which the liquid has a volume resistivity in excess of $10^9$ Ohm·cm and a dielectric constant below 3, and wherein pigment particles are dispersed with the aid of polymer molecules that are attached to said particles and improve their dispersion stability through the steric environment built up by said molecules.

According to the present invention a liquid developer composition is provided that is suitable for rendering visible electrostatically charged areas, which composition contains in an electrically insulating non-polar carrier liquid having a volume resistivity of at least $10^9$ Ohm·cm and a dielectric constant less than 3, dispersed toner and at least one substance influencing or conferring electric charges on the toner, said toner comprising a particulate colouring substance bearing a resin being a copolymer containing the following recurring units (A) and (B) or (A) and (C):

(A)

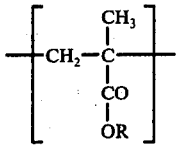

(B)

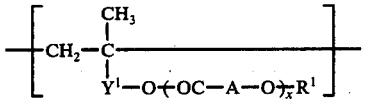

(C)

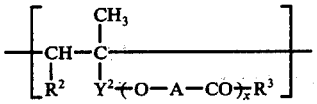

wherein:

R represents an alkyl group of 1 to 4 carbon atoms, preferably an isobutyl group, $R^1$ represents hydrogen or an acyl group e.g. an aliphatic acyl group containing an alkyl chain of 1 to 18 carbon atoms, $R^2$ represents hydrogen or carboxyl in free acid or salt form, $R^3$ represents hydroxyl or an ether group e.g. an alkoxy group containing preferably an alkyl chain of 12 to 18 carbon atoms, A represents an alkylene chain of 12 to 20 carbon atoms, preferably of 17 carbon atoms, $Y^1$ represents —CO—O—$CH_2$—CHOH—$CH_2$—, $Y^2$ represents —CO—, and $x$ represents 4 to 20.

Said resin constitutes a very good dispersing agent for pigment particles in a non-polar hydrocarbon liquid. In the above defined resins the recurring units represented by (B) and (C) form the solvatable part of the polymer molecule whereas part (A) operates as an adsorbent providing through said part adsorption of the copolymer to the pigment particles in said liquid. The solvatable part constitutes preferably at least 50% by weight of the copolymer.

Preferred copolymers according to the above general formula are listed in the following Table 1.

Table 1
| No. | Structural formula |
|---|---|
| 1 | 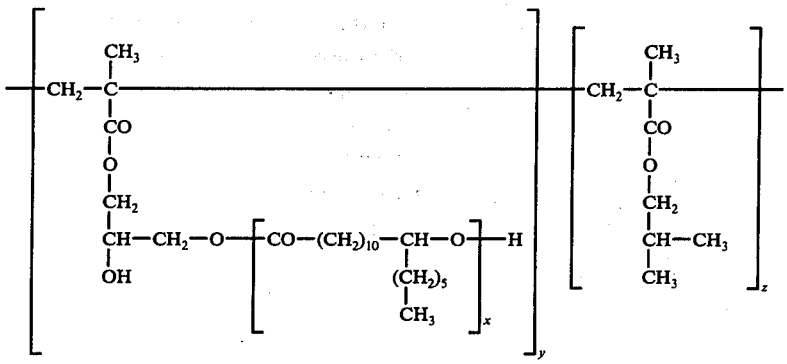 |
| | x = 6 (mean value); y = 50% by weight; z = 50% by weight |
| 2 | 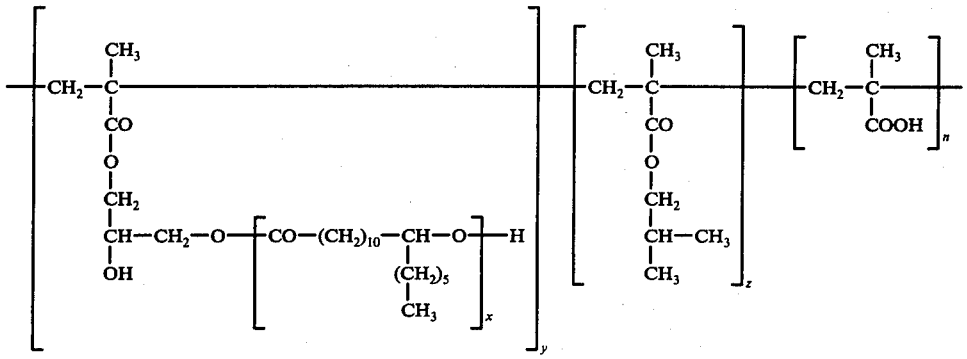 |
| | x = 6 (mean value); y = 49% by weight; z = 49% byweight; n = 2% by weight |
| 3 | 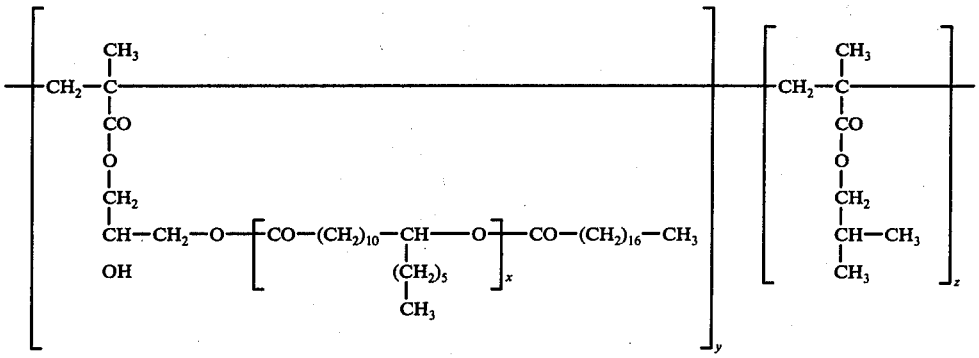 |
| | x = 6 ; y = 50% by weight; z = 50% by weight |
| 4 | 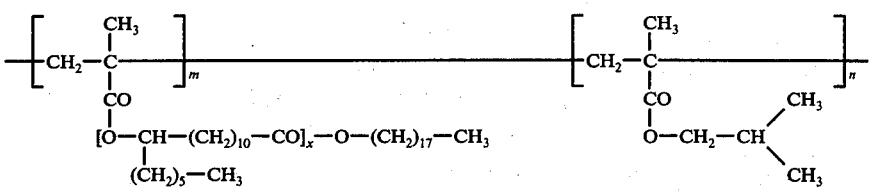 |
| | x = 4; m = 50% by weight; n = 50% by weight |

Table 1-continued

| No. | Structural formula |
|---|---|
| 5 | 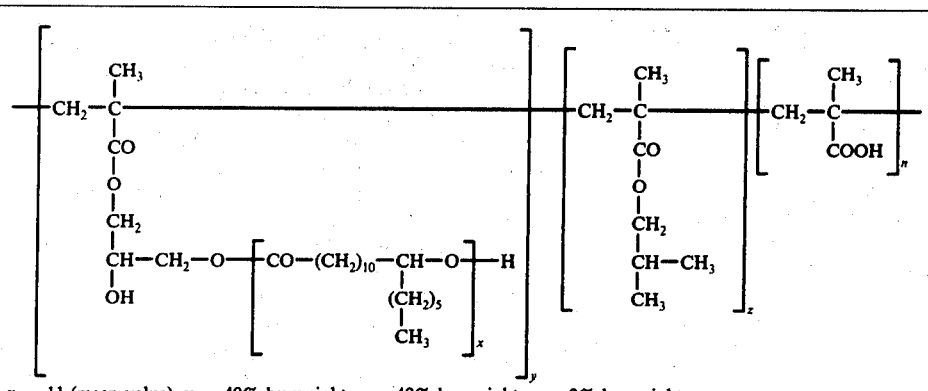 |

x = 11 (mean value); y = 49% by weight; z = 49% by weight; n = 2% by weight

In order to illustrate the preparation of the copolymers containing a $Y^1$ group the preparation of copolymer No.3 and of the intermediate compounds A and B used therefor is given as an example.

Preparation of copolymer No.3

Preparation of intermediate compound A:

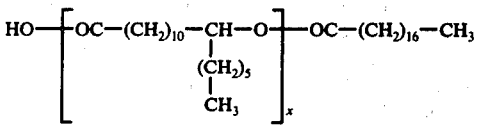

x = 6 (mean value)

In a reaction flask provided with a nitrogen gas inlet and a Dean and Stark separator a mixture of 570 g (1.9 mole) of 12-hydroxystearic acid, 28.4 g (0.1 mole) of stearic acid and 75 ml of xylene was heated on an oil-bath at 240° C. for 8 h. During that period 26 ml of water were eliminated. With a rotating evaporation device any residual xylene was removed whereby a dark brown viscous oil was left. Yield: 560 g. Acid number: 38.

Preparation of intermediate compound B:

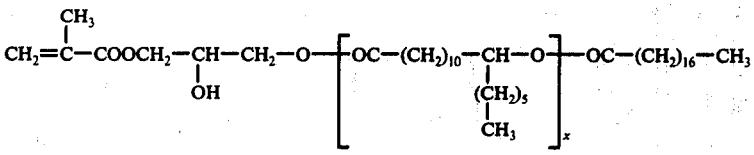

x = 6

170 g of intermediate compound A, 17.75 g of glycidyl methacrylate, 0.17 g of hydroquinone, 0.34 g of N,N'-dimethyldodecylamine and 200 ml of xylene were heated at reflux temperature in a reaction flask of 0.5 liter provided with a reflux condensor. Refluxing was terminated as soon as the obtained product showed an acid number smaller than 1. The reaction time was about 8 h. After cooling the solution was poured whilst stirring into 1.5 liters of methanol in order to remove the unreacted glycidyl methacrylate. Two layers were formed. The bottom layer was kept separate and dried. A dark brown viscous oil representing intermediate compound B was obtained. Yield: 165 g.

Copolymerisation

Whilst stirring 100 g of intermediate compound B, 100 g of isobutyl methacrylate, 0.4 g of azo-bis-isobutyronitrile and 400 ml of benzene were heated to 75° C. under nitrogen atmosphere for 24 h.

A viscous solution was obtained, which was used as such in the preparation of the electrophoretic developer of the present invention.

Preparation of copolymer No.4

Preparation of intermediate compound P corresponding to the following structural formula:

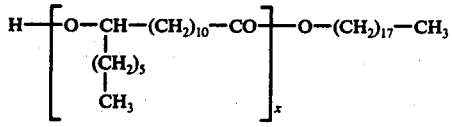

x = 4

In a reaction tube provided with a nitrogen-introducing capillary reaching to the bottom of the tube 54 g (0.18 mole) of 12-hydroxy-stearic acid, 8.1 g (0.03 mole) of stearyl-alcohol and a mixture of 15 mg of antimony trioxide and 30 mg triphenyl phosphate as catalysts were heated for 2 h at 200° C. while nitrogen was introduced in the reaction mixture. Water distilled off and after that period of 2 h the nitrogen bubble stream was replaced by a mechanical stirrer and the condensation reaction was continued for 6 h at 255° C. under reduced pressure (0.2 mm Hg). The reaction mixture was allowed to cool and used as such. Yield: 55 g. Acid number: 23.

Preparation of intermediate compound Q corresponding to the following structural formula:

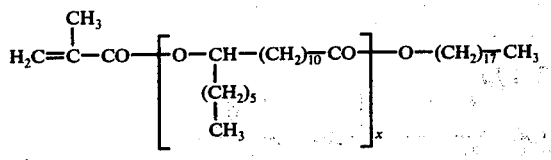

x = 4

50 g of intermediate compound P, 5.27 g of triethylamine (20% in excess) and 0.1 g of m-dinitrobenzene were dissolved in 250 ml of xylene in a 3-necked reaction flask of 1 liter provided with a stirrer, a dropping funnel and a reflux condensor. A solution of 5.45 g of methacryloyl chloride (20% in excess) dissolved in 50 ml of xylene was added dropwise at 20° C. Thereupon the reaction mixture was heated for 1 h at 100° C. and then cooled. Subsequently the reaction mass was washed with 1N hydrochloric acid, water, an aqueous sodium hydrogen carbonate solution and again with water. The washed product was precipitated in methanol, sucked off and dried under reduced pressure. Yield: 45 g.

Copolymerisation 45 g of intermediate compound Q, 45 g of isobutyl methacrylate and 180 mg of azobisisobutyronitrile were dissolved in 180 ml of benzene in a reaction flask of 500 ml provided with a stirrer, a nitrogen-introducing capillary tube and a reflux condensor. Whilst stirring and introducing nitrogen the reaction mixture was heated to 75° C. and the polymerisation carried out for 24 h at that temperature.

A light brown viscous solution was obtained, which was used as such in the preparation of the electrophoretic toner.

The organic polymeric material has the property of adhering to the pigment particles and of serving as a protective colloid in non-aqueous medium. The organic polymeric material on the pigment particles operates as a dispersing aid and may be considered as an oleoresinous wetting agent. The coating of polymeric material confers on the toner developer a better shelf life stability by sterical hindrance.

The dispersion stability of the developer is influenced by the amount of said copolymer which is present in an amount of preferably at least 0.25g per g of dry colouring substance. Optimal amounts for each pigment can be determined by simple tests.

The insulating liquid used as carrier liquid in the liquid developer in which the (B) and (C) part of the copolymer is solvatable may be any kind of non-polar, fat-dissolving solvent. Said liquid is preferably a hydrocarbon solvent e.g. an aliphatic hydrocarbon such as hexane, cyclohexane, iso-octane, heptane or isododecane, a fluorocarbon or a silicone oil. Thus, the insulating liquid is e.g. isododecane or a commercial petroleum distillate, e.g. a mixture of aliphatic hydrocarbons preferably having a boiling range between 150° C. and 220° C. such as the ISOPARS G, H, K and L (trade marks) of Exxon and SHELLSOL T (trade mark) of the Shell Oil Company.

The colouring substance used in the toner particles may be any inorganic pigment (said term including carbon) or solid organic dyestuff pigment commonly employed in liquid electrostatic toner compositions. Thus, for example, use can be made of carbon black and analogous forms thereof e.g. lamp black, channel black and furnace black e.g. Russ Printex 140 geperlt (tradename of DEGUSSA-Frankfurt/M, W. Germany).

Typical solid organic dyestuffs are so-called pigment dyes, which include phthalocyanine dyes, e.g. copper phthalocyanines, metal-free phthalocyanine, azo dyes and metal complexes of azo dyes.

The following dyes in pigment form are given for illustration purposes only: FANALROSA B Supra Pulver (trade-name of Badische Anilin- & Soda-Fabrik AG, Ludwigshafen, Western Germany), HELIOGENBLAU LG (trade-name of BASF for a metal-free phthalocyanine blue pigment), MONOASTRAL BLUE (a copper phthalocyanine pigment, C.I. 74, 160). HELIOGENBLAU B Pulver (trade-name of BASF), HELIOECHTBLAU HG (trade-name of Bayer AG, Leverkusen, Western Germany, for a copper phthalocyanine C.I. 74,160), BRILLIANT CARMINE 6B (C.I. 18,850) and VIOLET FANAL R (trade-name of BASF, C.I. 42,535).

Typical inorganic pigments include black iron(III) oxide and mixed copper(II) oxide/chromium(III) oxide/iron(III) oxide powder, milori blue, ultramarine cobalt blue and barium permanganate. Further are mentioned the pigments described in the French Pat. Nos. 1,394,061 filed Dec. 23, 1963 by Kodak Co., and 1,439,323 filed Apr. 24, 1965 by Harris Int.Corp.

Preferred carbon black pigments are marketed by DEGUSSA under the trade name PRINTEX. PRINTEX 140 and PRINTEX G are preferably used in the developer composition of the present invention. The characteristics of said carbon blacks are listed in the following Table 2.

Table 2

| | PRINTEX 140 | PRINTEX G |
|---|---|---|
| origin | channel black | furnace black |
| density | 1.8 g.cm$^{-3}$ | 1.8 g.cm$^{-3}$ |
| grain size before entering the developer | 29 nm | 51 nm |
| oil number (g of linseed oil adsorbed by 100 g of pigment) | 360 | 250 |
| specific surface (sq.m per g) | 96 | 31 |
| volatile material % by weight | 6 | 2 |
| pH | 5 | 8 |
| colour | brown-black | blue-black |

As colour corrector for the PRINTEX pigments preferably minor amounts of copper phthalocyanine are used, e.g. from 1 to 20 parts by weight with respect to the carbon black.

For a given charge density of the charge-carrying surface the maximum development density attainable with toner particles of a given size is determined by the charge/toner particle mass ratio, which is determined substantially by the amount of electrical polarity controlling substance employed.

In contrast to dry toners the liquid suspensed toner particles acquire normally their negative or positive charge from a chemical dissociation reaction on the toner particle surface and the introduction of a charged species in the carrier liquid to form the counterion. The principal charging mechanisms operating with a dissociation reaction are described e.g. by Robert B. Comizolli et al. in Proceedings of the IEEE, Vol.60, No.4, April 1972, p.363–364.

So, a liquid developer composition according to the present invention includes at least one substance (called "charge control" agent or substance) which influences or is responsible for electrical charging of the toner. The charge control substance(s) may have positive or negative charging effect. Mostly oil-soluble ionogenic substances (surfactants) e.g. metallic salts of organic acids with long aliphatic chain (e.g. containing at least 6 carbon atoms) are used for that purpose. By predominant adsorption of one ionic species the toner particles receive a net charge whose amount can be regulated by changing the additive concentration. In this way the sensitivity of the toner (i.e. deposited mass per surface charge) can be controlled. The polarity can be determined by appropriate choice of the surfactant. For example, a suspension of carbon black in liquid isoparaffins becomes negatively charged by overbased calcium petroleum sulphonate and positively charged by calcium diisopropylsalicylate. Mixtures of different charge control agents can be used. For example a mixture of different charge control agents having opposite charging effects can be used so that the strength of the charge on the toner or the polarity thereof can be adjusted by varying the ratio between the different agents (see U.K. patent specifications Nos. 1,411,287 1,411,537 and 1,411,739, all filed July 12, 1972 by the Applicant). Particularly suitable positively working charge control substances are described in the United Kingdom patent specification No. 1,151,141 filed Feb. 4, 1966 by Gevaert-Agfa N.V. These substances called charge control agents are bivalent or trivalent metal salts of:

(a) a monoester or diester of an oxyacid derived from phosphorus, (b) an oxyacid derived from phosphorus and containing one or two organic groups linked to the phosphorus atom by a carbon atom, or (c) an oxyacid derived from phosphorus and containing an ester group and an organic group linked by a carbon atom to the phosphorus atom, said organic group being aliphatic, cycloaliphatic or aromatic.

The organic group preferably comprises a chain of at least 4 carbon atoms, most preferably from 10 to 18 carbon atoms, and such chain may be substituted and/or interrupted by hetero-atom(s), e.g., oxygen, sulphur, or nitrogen atom(s).

Particularly good results are obtained with the zinc salts. However, other salts may also be used e.g. magnesium salts, calcium salts, strontium salts, barium salts, iron salts, cobalt salts, nickel salts, copper salts, cadmium salts, aluminium salts and lead salts.

The solubility in the electrically insulating carrier liquid of such metal salts can be promoted by the presence of one or more organic groups with branched structure, e.g. branched aliphatic groups, such as a 2-butyl-octyl group.

Other particularly suitable positively working charge control agents that are of special interest in the production of an electrophoretic developer with low charge/toner particle mass ratio are described in the United Kingdom patent application No. 38,068/75 filed Sept. 6, 1975 by the Applicant. That application discloses developer compositions, which contain as control agent a metal alkyl sulphonate in which the metal ion is a bivalent metal ion selected from the group consisting of zinc(II), lead(II), cadmium(II) and copper(II) or is a trivalent metal ion of the group VIII of the Periodic Table of the Elements, e.g. iron(III) or of the group VI B e.g. chromium(III), and in which the sulphonate group is present directly on an alkyl chain containing at least 6 carbon atoms in straight line. When using a said sulphonate as a charge control agent in a developer composition according to the present invention, the sizes of the toner particles and the amount in which said sulphonate is present may (as described in the aforesaid earlier U.K. patent application No. 38,068/75) be such that the toner can develop up to an optical density of at least 0.8, a charge pattern possessing a charge level corresponding to 50V for a capacitance of $1.5\times10^{-11}$ farad per sq.cm. A suitable amount of the sulphonate for a given toner developer can easily be determined by simple tests. By using a said metal alkyl sulphonate as charge control agent the specified results can be achieved with toner particles of a size commonly used in the electrophotographic art e.g. with toner particles sizing in the range of 0.2 to 2 μm. As disclosed in the said application an additional charge control agent can be used in conjunction with the metal alkyl sulphonate.

A liquid developer composition according to the present invention can be prepared by using dispersing and mixing techniques well known in the art. It is conventional to prepare by means of suitable mixers e.g. a 3-roll mill, ball mill, colloid mills, high speed stirrers, a concentrate of e.g. 15 to 80% by weight of the solid materials selected for the composition in the insulating carrier liquid and subsequently to add further insulating carrier liquid to provide the liquid toner composition ready for use in the electrostatic reproduction process. It is generally suitable for a ready for use electrophoretic liquid developer to incorporate the toner in an amount between 1 g and 20 g per liter, preferably between 2 g and 10 g per liter.

The copolymer can be applied as a pre-coating on the pigment particles prior to their use in making up the developer or can be introduced as a separate ingredient in the liquid and allowed to become adsorbed onto the pigment particles.

The electrophoretic development may be carried out using any known electrophoretic development technique or device. The field of the image to be developed may be influenced by the use of a development electrode. The use of a development electrode is of particular value in the development of continuous tone images. When no development electrode is used, the developed image may exhibit exaggerated density gradients which may be of interest e.g. in certain medical X-ray images for diagnostic purposes.

The following examples illustrate the present invention.

EXAMPLE 1

To 600 g of the copolymer No.3 as obtained in the above preparation, 2400 g of carbon black PRINTEX G (trade-name) were added and brought into dispersion with a high speed mixer.

After a mixing period of 2 to 24 h the solvent was evaporated and the cake of carbon black particles coated with the copolymer was ground to obtain particles of a mean size of 100 μm. They were dried at 30° C. under a reduced pressure of 15 mm Hg.

From the coated pigment mass 4 g were dispersed into 50 ml of isododecane together with 10 mg of zinc 2-hexyldecyl sulphonate as charge control agent for 15 h. From the obtained dispersion 25 ml were diluted with isododecane to 1 liter.

The obtained electrophoretic developer has a very high stability and a charge/toner particle mass ratio, which allows the development of a charge pattern within 3 to 10 seconds to a spectral density 1, the charge pattern having a charge of $3.10^{-9}$ C·cm$^{-2}$ on a dielectric support with a capacitance of $1.57\times10^{-11}$ F.cm$^{-2}$.

EXAMPLE 2

Example 1 was repeated with the difference, however, that copolymer No. 3 was replaced in a same weight by copolymer No.4. Analogous developing results were obtained.

We claim:

1. A liquid developer composition for use in developing electrostatic charge patterns, which composition contains in an electrically insulating carrier liquid having a volume resistivity of at least $10^9$ Ohm.cm and a dielectric constant below 3, a dispersed particulate colouring substance bearing at least one charge control substance and an organic polymeric material, wherein said polymeric material is a copolymer containing recurring units in the amount of at least about 49% by weight of B or C, a sufficient amount of A to adsorb the copolymer upon said dispersed particulate colouring substance, and up to about 2% by weight of D, wherein said units A–D have the following structural formulae:

(A)

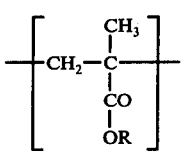

(B)

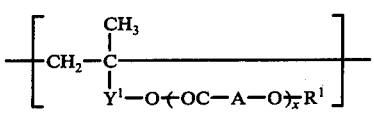

(C)

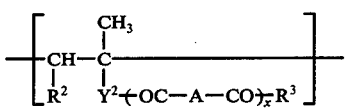

(D)

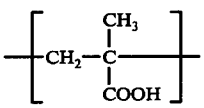

wherein:

R represents an alkyl group of 1 to 4 carbon atoms, $R^1$ represents a hydrogen or an acyl group, $R^2$ represents hydrogen or carboxyl in free acid or salt form, $R^3$ represents hydroxyl or an ether group, A represents an alkylene chain of 12 to 20 carbon atoms, $Y^1$ represents —CO—O—$CH_2$—CHOH—$CH_2$—, $Y^2$ represents —CO—, and $x$ represents 4 to 20.

2. A liquid developer composition according to claim 1, wherein A represents an alkylene chain of 17 carbon atoms and R represents an isobutyl group.

3. A liquid developer composition according to claim 1, wherein $R^3$ represents an alkoxy group with an alkyl chain of 12 to 18 carbon atoms.

4. A liquid developer composition according to claim 1, wherein the particulate colouring substance is carbon black.

5. A liquid developer composition according to claim 1, wherein the charge control substance(s) offer(s) a positive charge to the dispersed particulate substance.

6. A liquid developer composition according to claim 1, wherein such charge control substance imparts a negative charge to the dispersed particulate substance.

7. A liquid developer composition according to claim 1, wherein as charge control substance a metallic salt of an organic acid with aliphatic chain having at least 6 carbon atoms is used.

8. A liquid developer composition according to claim 5, wherein as charge control substance there is present a bivalent or trivalent metal salt of (a) a monoester or diester of an oxyacid derived from phosphorus, (b) an oxyacid derived from phosphorus and containing one or two organic groups linked to the phosphorus atom by a carbon atom, or (c) an oxyacid derived from phosphorus and containing an ester group and an organic group linked by a carbon atom to the phosphorus atom, said organic group being aliphatic, cycloaliphatic or aromatic.

9. A liquid developer composition according to claim 5, wherein as charge control substance there is present a metal alkyl sulphonate in which the metal ion is a bivalent metal ion selected from the group consisting of zinc(II), lead(II), cadmium(II) and copper(II) or is a trivalent metal ion of the group VIII of the Periodic Table of the Elements, and in which the sulphonate group is present directly on an alkyl chain containing at least 6 carbon atoms in straight line.

10. A liquid developer composition according to claim 1, wherein the insulating carrier liquid is an aliphatic hydrocarbon.

11. A liquid developer composition according to claim 1, wherein said copolymer is present in an amount of at least 0.25 g per g of dry colouring substance.

12. A method of rendering visible an electrostatic charge pattern on a dielectric material, which method comprises containing said surface with a liquid developer composition comprising charged toner suspended in an electrically insulating carrier liquid having a volume resistivity of at least $10^9$ Ohm·cm and a dielectric constant below 3, a dispersed particulate colouring substance bearing at least one charge control substance and an organic polymeric material, wherein said polymeric material is a copolymer containing recurring units in the amount of at least about 49% by weight of B or C, a sufficient amount of A to adsorb the copolymer upon said dispersed particulate colouring substance, and up to about 2% by weight of D, wherein said units A–D have the following structural formulae:

(A)

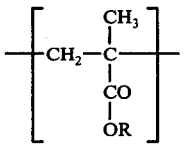

(B)

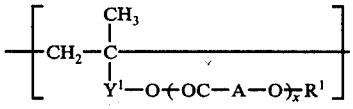

(C)

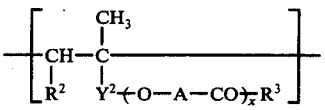

-continued
(D)
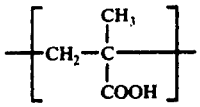
wherein:
R represents an alkyl group of 1 to 4 carbon atoms
$R^1$ represents hydrogen or an acyl group,
$R^2$ represents hydrogen or carboxyl in free acid or salt form,
$R^3$ represents hydroxyl or an ether group,
A represents an alkylene chain of 12 to 20 carbon atoms,
$Y^1$ represents —CH—O—$CH_2$—CHOH—$CH_2$—,
$Y^2$ represents —CO—, and
$x$ represents 4 to 20.
* * * * *